US011926974B2

(12) United States Patent
Winkels et al.

(10) Patent No.: US 11,926,974 B2
(45) **Date of Patent: *Mar. 12, 2024**

(54) INTERCHANGEABLE UNIT FOR TEXTURING GROUND SURFACE WORK AND ROAD CONSTRUCTION MACHINE HAVING SUCH AN INTERCHANGEABLE UNIT

(71) Applicant: Wirtgen GmbH, Windhagen (DE)

(72) Inventors: Sebastian Winkels, Windeck (DE); Dieter Bungarten, Neustadt (DE)

(73) Assignee: Wirtgen GmbH (DE)

( * ) Notice: Subject to any disclaimer, the term of this patent is extended or adjusted under 35 U.S.C. 154(b) by 0 days.

This patent is subject to a terminal disclaimer.

(21) Appl. No.: 17/876,983

(22) Filed: Jul. 29, 2022

(65) Prior Publication Data

US 2023/0018971 A1 Jan. 19, 2023

Related U.S. Application Data

(63) Continuation of application No. 17/224,846, filed on Apr. 7, 2021, now Pat. No. 11,401,665.

(30) Foreign Application Priority Data

Apr. 24, 2020 (DE) ..... 10 2020 111 311.0

(51) Int. Cl.
*E01C 23/088* (2006.01)
*E01C 23/09* (2006.01)
*E01C 23/12* (2006.01)

(52) U.S. Cl.
CPC ..... *E01C 23/088* (2013.01); *E01C 23/127* (2013.01); *E01C 23/0933* (2013.01)

(58) Field of Classification Search
CPC ... E01C 23/088; E01C 23/127; E01C 23/0933
See application file for complete search history.

(56) References Cited

U.S. PATENT DOCUMENTS 5,094,565 A 3/1992 Johnson
8,056,549 B1 11/2011 Fleetwood
(Continued)

FOREIGN PATENT DOCUMENTS

DE 8508708 U1 1/1986
DE 102012024452 A1 6/2013
(Continued)

OTHER PUBLICATIONS

EPO Search Report for corresponding patent application No. EP 21 16 9374, dated Sep. 24, 2021, 5 pages. (not prior art).
(Continued)

*Primary Examiner* — Janine M Kreck
(74) *Attorney, Agent, or Firm* — Lucian Wayne Beavers; Patterson Intellectual Property Law, PC

(57) ABSTRACT

The present invention relates to an interchangeable unit (28) for material-removing work on a subsoil (U) starting from ground surface (A), the interchangeable unit (28) being designed for operational physical and functional coupling to a machine frame (12) of a road construction machine (10), the interchangeable unit (28) comprising:

a housing (30), a removal tool (32), which is mounted on the housing (30) so as to be rotatable about a working axis (R) and of which a circumferential section protrudes from a working opening (30*c*), a drive belt pulley (62), which is rotatably mounted on the housing (30) and is able to be coupled to a drive belt (58), a transmission gear unit (76), which transmits torque and rotary motion from the drive belt pulley (62) to the removal tool (32) by reversing the direction of rotation, at least the axis of rotation (P62) of the drive belt pulley (62) running at a distance from the working axis (R).

(Continued)

According to the invention, a working shaft assemblage (74) penetrates a housing wall (30*d*) of the housing (30), the working shaft assemblage (74) connecting the removal tool (32) with a working gear component (70) situated on the side of the housing wall (30*d*) facing away from the removal tool (32) for equidirectional joint rotation, the transmission gear unit (76) being situated between the drive belt pulley (62) and the working gear component (70).

13 Claims, 3 Drawing Sheets

(56) References Cited

U.S. PATENT DOCUMENTS

| | | | | |
|---|---|---|---|---|
| 9,033,423 | B2 | 5/2015 | Darscheid et al. | |
| 9,624,628 | B2 | 4/2017 | Busley et al. | |
| 9,783,938 | B2 | 10/2017 | Reuter | |
| 10,676,881 | B2 * | 6/2020 | Desch | B60K 25/00 |
| 11,401,665 | B2 * | 8/2022 | Winkels | E01C 23/088 |
| 2003/0127905 | A1 | 7/2003 | Haroldsen et al. | |
| 2013/0154339 | A1 | 6/2013 | Darscheid et al. | |
| 2013/0300182 | A1 | 11/2013 | Hammes et al. | |
| 2014/0265525 | A1 | 9/2014 | Schafer et al. | |
| 2015/0091363 | A1 * | 4/2015 | Reuter | B60K 25/06 475/6 |
| 2017/0130406 | A1 | 5/2017 | Steeg et al. | |

FOREIGN PATENT DOCUMENTS

| | | | |
|---|---|---|---|
| DE | 102012008252 | A1 | 10/2013 |
| DE | 102012012738 | A1 | 1/2014 |
| DE | 102012024770 | A1 | 6/2014 |
| EP | 1294991 | B1 | 7/2006 |

OTHER PUBLICATIONS

German Office Action for corresponding German Application Serial No. 10 2020 111 311.0 dated Feb. 19, 2021, 6 pages (not prior art).

* cited by examiner

INTERCHANGEABLE UNIT FOR TEXTURING GROUND SURFACE WORK AND ROAD CONSTRUCTION MACHINE HAVING SUCH AN INTERCHANGEABLE UNIT

BACKGROUND OF THE INVENTION

1. Field of the Invention

The present invention relates to an interchangeable unit for material-removing work on a subsoil starting from a ground surface, the interchangeable unit being designed for operational physical and functional coupling to a machine frame of a road construction machine, the interchangeable unit comprising:

- a housing, the housing having, in a connecting section for physically coupling the interchangeable unit to a road construction machine, connecting configurations for connecting the interchangeable unit to a machine frame of a road construction machine, and the housing having a working opening in a working section situated remotely from the connecting section,
- a removal tool, which is mounted on the housing so as to be rotatable about a working axis and of which a circumferential section protrudes from the working opening,
- a drive belt pulley, which is rotatably mounted on the housing and is able to be coupled to a drive belt for functionally coupling the interchangeable unit to the road milling construction machine,
- a transmission gear unit, which transmits torque and rotary motion from the drive belt pulley to the removal tool by reversing the direction of rotation, at least the axis of rotation of the drive belt pulley running at a distance from the working axis.

2. Description of the Prior Art

Such an interchangeable unit comprising a milling drum as removal tool is known from DE 10 2012 008 252 A1, for instance. Milling drum housings that are repeatedly releasably connectable to a machine frame of a road milling machine are common, however.

Furthermore, milling drum units for road milling machines are known from EP 1294991 B2, DE 10 2012 024 770 A1, and DE 10 2012 024 452 A1, which have an additional drive in order to be able to rotate the milling drum independently of the main drive of the milling drum. DE 10 2012 024 770 A1 and EP 1294991 B2 teach to use the auxiliary drives for maintenance purposes in order to be able to rotate a milling drum at low speed or in stepwise fashion about its working axis so that a worker is able to check and, if necessary, service the milling bits situated in distributed fashion on the drum casing of the milling drum. DE 10 2012 024 452 A1 teaches to accelerate a milling drum using an additional drive to a rotational speed near its removal speed in normal operation so as then to couple in the main drive in slip-free fashion and to couple out the additional drive.

An earth working machine sui generis is known from U.S. Pat. No. 8,056,549 B1, which has as its removal tool a cutting drum having a plurality of cutting disks, which are situated at an axial distance from one another relative to the working axis of the removal tool. This cutting drum known as a "grooving drum" is used for texturing a ground surface, for example for grooving a ground surface. In contrast to the previously mentioned milling drums, which completely remove a ground surface across their working width down to a respectively set milling depth along the advance path of the milling drum, the working result produced when using a grooving drum or generally a surface-texturing drum is a defined surface profile of the ground to be worked. This normally means that over the working width of the surface-texturing drum only a portion of the ground surface is removed in a defined manner, while another portion of the ground surface remains in its original state.

The interchangeable milling unit known from the related art and mentioned at the outset, which has a milling drum that is able to be releasably accommodated on it and attached to it, has at least a considerable portion of the transmission gear unit in an internal tube, which is accommodated in the material-removing milling drum for removal operation and which in the operational state is surrounded radially on the outside by the milling drum. Hence, the transmission gear unit is located on the one hand in the torque path between the drive belt pulley, as the sole belt pulley protruding on the housing of the known interchangeable milling unit, and the milling drum and is on the other hand surrounded radially on the outside by the milling drum.

Due to the low cutting speeds, which amount to approximately 10 $ms^{-1}$ or less, and the relatively large circular cutting diameter of milling drums in the range of approximately 0.8 m to 1.2 m, the transmission gear unit of the known interchangeable milling unit is a speed reduction gear, which greatly gears down the considerably higher speed of the drive motor of the milling drum. The planetary gear set required for the typical speed reduction gear ratios of road milling machines in the range of 18:1 to 21:1 is costly to produce and to install, but is advantageously accommodated radially within the milling drum tube supporting the milling bits and in the case of exchangeable milling drums even within the internal tube that is permanently mounted on the housing of the exchangeable unit so as to be rotatable about the working axis.

If the rotating removal tool has an inner clearance with an inside diameter of less than 50 cm, however, such a removal tool can no longer be accommodated by a conventional interchangeable unit as described at the outset since such a removal tool would inevitably collide with the conventional transmission gear unit in the attempt to bring it into an operational state on the interchangeable unit, long before it would be in an operational state.

The surface-texturing removal tools described above usually operate at markedly higher cutting speeds than milling drums. To avoid undesirably high mass moments of inertia of such removal tools acting around the working axis, these are designed having markedly smaller circular cutting diameters than conventional milling drums. Instead, their rotational speed during their normal removal operation is markedly higher than the removal speed of conventional milling drums.

It is the objective of the present invention to indicate a technical teaching that makes it possible to use conventional road milling machines, which are designed on the machine frame side for milling ground surfaces by using milling drums equipped with individual milling bits, also for other types of ground work, in particular for texturing ground surfaces.

SUMMARY OF THE INVENTION

The present invention achieves this objective by an interchangeable unit of the type mentioned at the outset, in which a working shaft assemblage penetrates a housing wall of the housing, the working shaft assemblage connecting the removal tool with a working gear component situated on the side of the housing wall facing away from the removal tool for equidirectional joint rotation, the transmission gear unit being situated between the drive belt pulley and the working gear component.

Thus, the interchangeable unit according to the present invention comprises not only the drive belt pulley, but additionally also a working gear component, which is shielded from the removal tool by the housing wall. The transmission gear unit is thus able to transmit torque from the drive belt pulley to the working gear component at a desired transmission ratio and by reversing the direction of rotation. By way of the working shaft assemblage, the working gear component ultimately transmits the torque and the rotary motion transmitted by the transmission gear unit simply and efficiently onto the removal tool as an equidirectional rotary motion.

Thus, it is possible to accommodate even a removal tool having considerably smaller dimensions, in particular smaller radial dimension with regard to the working axis, in the interchangeable unit and to drive it via the drive belt pulley. The drive belt pulley is connectable to a source of drive force of a road construction machine originally designed as a road milling machine. For road milling machines likewise use a drive belt to transmit torque between their source of drive force and the drive belt pulley of the interchangeable milling unit. The interchangeable unit of the present invention thus uses the devices on the side of the road construction machine for transmitting torque and allows for connection to the latter. Thus, it is possible to retool a road milling machine, to which initially a conventional interchangeable milling unit having a milling drum accommodated therein is coupled, for ground work other than milling by exchanging the conventional interchangeable milling unit against the interchangeable unit described above. This applies also in the opposite direction for retooling from ground work other than milling to milling work.

Since the removal tool of the interchangeable unit of the present invention normally has considerably smaller radial dimensions with respect to the working axis than a milling drum, but may also be brought into contact with the ground to be worked, the working axis of the interchangeable unit of the present application is at a greater distance from the connecting section of the housing than the milling axis of an interchangeable milling unit having a milling drum given otherwise comparable dimensions of the housing of known interchangeable milling units and the housing of the present interchangeable unit. The approximately equal dimensions of the housings of the interchangeable milling unit and of the present interchangeable unit are based on their connectability to and their intended usability on one and the same machine frame of a road construction machine for respective ground work.

To be sure, it is not impossible for the working shaft assemblage to comprise a plurality of drive shafts, for example as a working shaft train with a possible countershaft, which are connected to one another in a torque-transmitting manner. For reasons of simple manufacture and installation as well as reduced susceptibility to damage, however, a single working shaft is preferred as the working shaft assemblage, which connects the working gear component rigidly to the removal tool for rotation at identical speed and in identical direction.

In principle, the working gear component may be any gear component such as for example a gear wheel, in particular a spur wheel or even a friction wheel. Preferably, however, the working gear component is a working belt pulley. In that case, it is possible for example according to a first, less preferred specific embodiment for a drive belt driven to rotate by a motor on the machine frame to transmit torque to the working belt pulley. The drive belt pulley primarily supports the drive belt. The drive belt is supported on the drive belt pulley by its radially inner surface facing the volume enclosed by the drive belt and abuts against the working belt pulley with its opposite radially outer surface in a torque-transmitting manner. The drive belt pulley, the working belt pulley, and the drive belt then form the transmission gear unit since the abutment of the aforementioned belt pulleys on opposite sides of the drive belt effects a reversal of the direction of rotation so that the working belt pulley rotates in the opposite direction as the drive belt pulley. By selecting the diameters of the working belt pulley and of a machine frame-side output belt pulley drivable by a machine-side drive force source it is possible within certain limits to set a speed transmission ratio between the machine frame-side drive force output and the removal tool.

To achieve a greatest possible looping angle of the working belt pulley, a further belt pulley may be provided in such a way that the working belt pulling is situated between the drive belt pulley and the further belt pulley. Although this development of the change frame is possible, it is not preferred because of the comparatively great required length of the drive belt, The design of the working gear component as a working belt pulley has the further advantage, however, that a separate working belt drive may be developed and situated on the interchangeable unit, which may remain permanently on the interchangeable unit. Belt drives have proven reliable as means for transmitting torque in road construction machines.

In a concrete structural development of the aforementioned working belt drive, the transmission gear unit may comprise an intermediate belt pulley, a first coupling device and a working belt as a second coupling device, the first coupling device coupling the drive belt pulley and the intermediate belt pulley to one another in torque-transmitting fashion and the working belt coupling the intermediate belt pulley and the working belt pulley to one another in torque-transmitting fashion. In that case, only the aforementioned belt pulleys, i.e., the drive belt pulley, the intermediate belt pulley and the working belt pulley, and the working belt are preferably visible on the housing.

A simple possibility for implementing the reversal of the direction of rotation required by the transmission gear unit may be achieved in that the transmission gear unit comprises as the first coupling device a gear wheel transmission stage having an even number of meshing gear wheels so that in the gear wheel train as a whole the direction of rotation is reversed. For example, using four gear wheels it is possible to bridge a comparatively great center distance at a comparatively small space requirement for the gear wheel transmission stage since each of the four gear wheels may be developed having a smaller diameter than if the same center distance were bridged by only two gear wheels. For reasons of a lowest possible number of components and thus a lowest possible expenditure for assembly, the gear wheel transmission stage may comprise exactly two meshing gear wheels. The gear wheels of the gear wheel transmission stage are preferably spur gears so that the gear wheel transmission stage, with respect to the axes of rotation of the gear wheels, requires a smallest possible axial space. The axes of rotation of the gear wheels are preferably parallel to the working axis.

Since the removal tool, compared to conventional milling drums and their circular cutting diameter of between 0.8 m and 1.2 m, preferably has a markedly smaller circular cutting diameter of 0.6 m or less, the gear wheel transmission stage may be readily situated entirely radially—with respect to the working axis—outside of the radial extension area, which may also be referred to as an outer circumference, of the removal tool. This eliminates the necessity, which exists in the case of interchangeable milling units, of situating the transmission gear unit or parts thereof radially within the removal tool. Since it is not necessary for the transmission gear unit to fit into the removal tool, the designer of the interchangeable unit in designing the transmission gear unit is not bound to the spatial limitations known in the case of interchangeable milling units.

In order to make maximal use of the axial dimension of the interchangeable unit along the working axis for accommodating ground material-removing cutting tools and for achieving a maximal working width in a given dimension of the interchangeable unit, the gear wheel transmission stage is preferably positioned axially—relative to the working axis—overlapping with the axial extension area of the removal tool. This may also be described as locating the gear wheel transmission stage within an axial length of the removal tool. This axially overlapping arrangement is facilitated in particular by situating the gear wheel transmission stage entirely radially outside of the removal tool.

In contrast to interchangeable milling units, in which the distance of the drive-side housing wall from the nearest end face of the milling drum is often considerably greater than the distance of the idle-side housing wall from the opposite end face of the milling drum due to the speed reduction gear being situated at least sectionally within the milling drum, in this case the removal tool may be brought approximately equally close to the respective housing walls both on the drive side as well as on the idle side.

Ground work that removes ground material inevitably results in aggressive, particle-laden immediate surroundings of the removal tool during normal removal operation. During the removal operation, the rotating removal tool has a high kinetic energy, which it transmits onto particles removed from the ground. In order to prevent the aggressive, abrasive surroundings of the removal tool from impairing or even damaging the gear wheel transmission stage, the gear wheel transmission stage is preferably physically shielded from the removal tool. The gear wheel transmission stage is preferably accommodated in a transmission stage housing, which encloses the gear wheel transmission stage housing on all sides. This makes it possible to transport, store, and exchange the gear wheel transmission stage as an all-round enclosed assembly together with its housing. A simplification in the design by reducing the required number of components may be achieved in that a wall of the transmission stage housing is also a wall of the housing of the interchangeable unit.

Preferably, the drive belt pulley and the working gear component, in particular as a working belt pulley, and further preferably also the intermediate belt pulley are all situated on the same wall of the housing of the interchangeable unit and protrude from the latter on the same side. Road construction machines normally have a drive side, from which torque is supplied to the removal tool and is introduced into the latter. The so-called "idle side" lies opposite from the drive side along the working axis. The housing wall, from which the working gear component and the aforementioned belt pulleys protrude, is preferably the drive-side wall of the interchangeable unit. The gear wheel transmission stage is preferably also situated on this wall due to the spatial proximity to the drive belt pulley and to the intermediate belt pulley. The drive-side wall of the interchangeable unit may therefore also be a wall of the transmission stage housing.

For utilizing the space available in the housing of the interchangeable unit, the gear wheel transmission stage is preferably situated on the same side of the wall of the interchangeable unit as the removal tool, that is, on the opposite side of the wall, from which the drive belt pulley, the working gear component and, if applicable, the intermediate belt pulley protrude.

In order to achieve a compact construction, a gear wheel of the gear wheel transmission stage is connected to the drive belt pulley for rotation in the same direction and at the same speed and a further gear wheel is connected to the intermediate belt pulley for rotation in the same direction and at the same speed. The two aforementioned gear wheels are preferably each connected by a rigid shaft to the aforementioned belt pulleys. Depending on the center distance between the drive belt pulley axis and the intermediate belt pulley axis to be bridged by the gear wheel transmission stage, the two gear wheels coupled directly to the respective belt pulleys may be the sole gear wheels of the gear wheel transmission stage or an even number of further gear wheels may be situated between the gear wheels for transmitting torque.

Removal tools having smaller circular cutting diameters than the known milling drums often rotate at higher speeds than milling drums in normal removal operation. For this reason, in contrast to the case of milling drums, it is not necessary greatly to reduce the drive belt speed supplied on the machine frame side by the road construction machine. The gear wheel transmission stage therefore preferably has a speed transmission ratio of between 0.3 and 5, compared to a speed reduction ratio of approximately 20 in milling drums. Speed transmission ratios near one are preferred, that is, preferably of between 0.5 and 2, particularly preferably of between 0.75 and 1.5. The selection of the precise speed transmission ratio of the gear wheel transmission stage also depends on the selected diameters of the belt pulleys involved in the torque transmission path, but a speed transmission ratio of between 0.9 and 1.3 is particularly preferred since this allows for the use of gear wheels of approximately the same size in the gear wheel transmission stage. The speed transmission ratio is preferably slightly different than 1 so as to avoid always engaging the same pairs of teeth with one another per gear wheel rotation, which may result in unwanted high wear of the tooth faces.

What was said in the preceding paragraph about the speed transmission ratio of the gear wheel transmission stage is applicable if the gear wheel transmission stage has more than two gear wheels, preferably for the speed transmission ratio of each gear wheel pairing.

In normal operation, the removal tool, which normally rotates faster than known milling drums, has a cutting speed of between 20 and 80 $ms^{-1}$, preferably of between 29 and 62 $ms^{-1}$.

In principle, the removal tool may be any removal tool for earth material-removing surface texturing of a ground surface. The removal tool is preferably a cutting drum for grooving work on ground surfaces. Such cutting drums are known in the related art as "grooving drums" or as "grinding drums." Along the working axis, such drums may have cutting disks, possibly interspersed with spacers defining an axial spacing, which are equipped with cutting edges along their circumference. These cutting disks often have geometrically indefinite cutting edges due to grain abrasive bonded on their outer surface such as ceramic grain or diamond, for example.

Since the removal tools of the interchangeable unit presented here rotate at comparatively high rotational speeds in normal removal operation, it may be advantageous, for the purpose of reaching the operating speed in a manner that is as gentle as possible for the drive train, if the interchangeable unit comprises a start-up motor, which is separably connected in torque-transmitting fashion to the removal tool via the interpolation of a start-up clutch. The start-up motor is then able to accelerate the removal tool starting from standstill to a first limit speed, starting at which a machine frame-side motor takes over the further rotary drive of the removal tool. The start-up motor may then be separated from the drive train of the removal tool via the start-up clutch so as to avoid an unwanted overrun of the start-up motor by the machine frame-side motor as the main drive of the removal tool. A freewheeling clutch is also a start-up clutch in the sense of the present application.

The start-up clutch is preferably a separately switchable clutch device, which is situated in the drive train between the start-up motor and the removal tool. However, the start-up clutch may be implemented with the already existing components by the working belt and a working belt tensioner that changes the tension of the working belt. For this purpose, the working belt tensioner may comprise a tensioning roller and an actuator displacing the tensioning roller.

The start-up motor may also support braking the removal tool in a desired deceleration or overrun condition. In such an overrun condition at a decreasing rotational speed of the removal tool, for example beginning with the aforementioned first limit speed and below, the removal tool drives the start-up motor so that its resistance against motion gradually brakes the removal tool.

The start-up motor may be coupled with an energy store, preferably an on-board energy store of the interchangeable unit, with which the start-up motor is in an energy transmission connection. During an acceleration operation, the start-up motor is able to receive energy transmitted from this energy store. During a deceleration operation of the start-up motor, the start-up motor is able to restore energy to the energy store.

For example, the start-up motor may be a hydraulic start-up motor, which acts as a hydraulic pump in an overrun condition. Alternatively, the start-up motor may be an electric motor, which operates as a generator or as an eddy-current brake in an overrun condition. Depending on the type of start-up motor, the energy store may be a hydraulic energy store or an electric energy store.

The interchangeable unit preferably comprises, particularly preferably in the connecting section, at least one hydraulic quick coupling in order to be able to connect an interchangeable unit-side hydraulic line quickly and simply to a machine frame-side hydraulic line of the road construction machine and thus for example to ensure a supply of a hydraulic start-up motor with machine frame-side hydraulic oil.

Additionally or alternatively, the interchangeable unit comprises, preferably in the connecting section, an electric connection device, for example at least one plug connector and/or at least one socket, in order to connect an interchangeable unit-side electric line quickly and simply to a machine frame-side electric line and thus to be able to ensure for example a supply of an electric start-up motor with electrical energy provided on the side of the machine frame and/or electrically to connect sensors and/or actuators situated on the interchangeable unit to the control unit of the road construction machine.

The start-up motor is preferably accommodated in the housing of the interchangeable unit and thus protected against external influences. There it is preferably shielded from the aggressive surroundings of the removal tool, for example by a separating wall situated between the start-up motor and the removal tool. Like the gear wheel transmission stage, the start-up motor may be accommodated in a separate start-up motor housing. At least one wall of the start-up motor housing is preferably a common wall either with the transmission stage housing or with the housing of the interchangeable unit. Utilizing short connecting paths, the start-up motor may be connected to the drive belt pulley or to the intermediate belt pulley directly, that is, only by the interpolation of the start-up clutch, in torque-transmitting fashion. If the intermediate belt pulley is provided, the start-up motor is preferably directly connected to it in torque-transmitting fashion so that the torque transmission path from the start-up motor to the removal tool is as short as possible.

The present invention further relates to a self-propelled road construction machine, comprising:

- a machine frame,
- a traveling gear having at least three drive units, which stand in rollable fashion on a subsoil,
- a motor having an output shaft that provides torque,
- an output belt pulley drivable by the motor,
- connecting counterpart configurations for connecting the machine frame to an interchangeable unit as recited above,
- an interchangeable unit, as it is described and developed above, the interchangeable unit being releasably connected to the machine frame by way of its connecting configurations and the connecting counterpart configurations of the machine frame, and
- a drive belt, which connects the output belt pulley to the drive belt pulley in torque-transmitting fashion.

A rotary bearing of the output belt pulley is permanently secured on the machine frame directly or indirectly by interpolation of at least one further component or one further assembly.

The connecting configurations and connecting counterpart configurations are preferably mutually cooperating positive locking means, such as for example hooks, bars and/or bolts on the one hand and eyes, openings and/or recesses on the other hand, the respective hook, bar or bolt engaging behind or penetrating the associated eye, opening or recess or engaging in the respective configuration. The eyes, openings and/or recesses engaged from behind by connecting counterpart configurations are preferably developed in the connecting section of the housing of the interchangeable unit or are firmly connected to the latter. The engaging components such as hooks, bolts or bars are preferably situated on the machine frame or firmly connected to the latter for easier automated adjustability. Additionally or alternatively, openings may be developed in the machine frame as well as in the housing of the interchangeable unit, which are aligned with one another in the connected state and are coupled to one another by bolts, which penetrate both aligned openings. Such bolts may be removable both from the machine frame as well as from the interchangeable unit. In order to facilitate the connection between the machine frame and the interchangeable unit, the connecting counterpart configurations may be driven by actuators for an engagement movement since the connecting counterpart configurations, which are permanently connected to the machine frame, are more readily supplied with energy of the road construction machine than the connecting configurations situated on the interchangeable unit.

In principle, the output shaft of the motor may support the output belt pulley directly. Frequently, however, the motor, in particular a diesel engine, is used as a power plant of the road construction machine in order to supply energy to various unit of the road construction machine. For this reason, a transmission, preferably having at least one auxiliary drive, is preferably situated between the output belt pulley and the output shaft of the motor. Preferably, a pump transfer gear is situated between the motor and the output belt pulley so that on the basis of the output shaft it is possible to drive energy converters, such as hydraulic pumps and possibly electrical generators, and furthermore the removal tool. The pump transfer gear may be a switchable pump transfer gear so as to be able to establish different operating states on the output belt pulley. In a first switching state, the pump transfer gear is able to connect the output belt pulley in the same direction and at the same speed to the output shaft of the motor and in a second switching state, distinct from the first, is able to connect the output belt pulley to the output shaft to rotate in the same direction but at a rotational speed that is changed by a speed transmission ratio with respect to the rotational speed of the output shaft.

In order to be able to change the speed transmission ratio between the motor of the road construction machine and the drive belt pulley to a greater extent, the road construction machine may include at least two output belt pulleys of different diameters, which are interchangeable. One of the output belt pulleys is coupled to the motor as the rotary drive, and at least one other is carried along in the road construction machine, for example in a storage space. Thus, if necessary, it is also possible to adapt a transmission ratio if the road construction machine is changed over between different types of earth work by an exchange between an interchangeable milling unit and an interchangeable unit of the present application.

The use of a belt drive allows for changing the capacity for transmitting torque by changing the belt tension. Thus, the belt drive itself may be used as a kind of slip coupling. For this purpose, the road construction machine preferably also has a displaceable drive belt tensioner, the displacement of which is able to modify the tension of the drive belt.

If the road construction machine comprises an interchangeable unit with start-up motor developed as described above, where the start-up motor and the start-up clutch connecting the start-up motor with the removal tool is controllable by a controller of the road construction machine, the road construction machine is preferably designed to carry out the following method for accelerating or decelerating the rotation of the removal tool:

switching the start-up clutch into a and/or holding the start-up clutch in a torque-transmitting connection state if the removal tool rotates at a speed that is lower than or equal to a first limit speed, the first limit speed being lower than the removal speed of the removal tool in normal removal operation, switching the drive belt tensioner into a and/or holding the drive belt tensioner in an operating state, which effects an idling tension of the drive belt, which is lower than the operating tension of the drive belt in normal removal operation of the removal tool if the removal tool rotates at a speed that is lower than a second limit speed, the second limit speed being lower than or equal to the first limit speed, changing the tension of the drive belt between the idling tension and a belt tension that is closer to the operating tension, preferably is the operating tension, in the same direction as the speed of the removal tool between the second limit speed and the removal speed, i.e., the tension of the drive belt is increased over time if the speed of the removal tool increases over time and vice versa.

The first limit speed may be 50% or less of the removal speed. Since particularly the start-up from idling requires a particularly high torque, it suffices if the start-up motor supports the machine frame-side motor of the road construction machine in a speed range of the removal tool near standstill and preferably including a speed of zero. It may therefore suffice if the first limit speed does not fall below 5% or 10% or even 15% of the removal speed. For the aforementioned reasons, it may also suffice if the first limit speed does not exceed 30%, preferably 25% of the removal speed.

In an acceleration process, in which the speed of the removal tool rises, the start-up clutch is first brought into a connection state and is maintained in the latter so that the start-up motor is able to accelerate the removal tool. During this phase, the tension of the drive belt is the idling tension at least up to the second limit speed, possibly up to the first limit speed, so that the start-up of the removal tool does not interfere with the motor of the road construction machine and vice versa. If the speed of the removal tool exceeds the first limit speed, the removal tool is driven solely by the motor of the road construction machine via the belt drive. In this phase, at the latest at the beginning of the removal operation, the drive belt tensioner reaches an operating state, in which it maintains the drive belt at operating tension. When the removal speed is reached, but still prior to the start of a removal operation, a lower belt tension than the operating tension may suffice due to the lower load on the rotating removal tool.

In order to be able to transfer the removal tool during an acceleration process gently from the start-up motor to the motor of the road construction machine, upon reaching the second limit speed and exceeding the same, the drive belt tensioner may be displaced in such a way that the tension of the drive belt gradually rises from the idling tension to the operating tension.

A deceleration process of the removal tool runs in the opposite direction. Starting from the removal speed, the speed of the removal tool is reduced until starting with the first limit speed the start-up motor is connected to the removal tool via the start-up clutch so that the removal tool in an overrun condition drives the start-up motor and is braked by the latter. The drive belt tensioner may be displaced in such a way that the tension of the drive belt gradually reaches the idling tension when the speed of the removal tool reaches the second limit speed.

In contrast to the acceleration of the removal tool, when decelerating the removal tool, the belt tension in the drive belt may alternatively be maintained as operating tension so that the removal tool to be decelerated must overcome a highest possible drag torque or is coupled to a greatest possible mass moment of inertia. Since the motor of the road construction machine is operated at a speed that is as constant as possible, the motor is separable from the output belt pulley preferably by a separate clutch.

The first limit speed is normally structurally predetermined by the start-up motor. For example, the first limit speed may be a maximum operating speed of the start-up motor or its nominal speed.

The present invention also relates generally to a self-propelled road construction machine that is convertible for performing different types of removal work, which may comprise:

- a machine frame,
- a traveling gear having at least three drive units, which stand in rollable fashion on a subsoil,
- a motor having an output shaft that provides torque,
- connecting counterpart configurations, which are developed for connecting the machine frame to connecting configurations of at least two different interchangeable units having each one removal tool, the removal tools being designed for removal work of different removal types, and
- a torque transmission coupling, which is designed for establishing a releasable torque-transmitting connection between the motor and the removal tool of the interchangeable unit respectively connected via the connecting counterpart configurations.

The torque transmission coupling may comprise the drive belt described above as a possible specific embodiment of a torque transmission coupling. Releasing the torque-transmitting connection may utilize tools so as to be able to transmit even a maximum torque in terms of absolute value via the coupling.

Different types of removal, such as for example milling on the one hand and texturing surfaces on the other hand, are to be distinguished from removal work of the same type in different dimensions, such as for example milling using milling drums of different working widths and/or different line spacings.

The road construction machine is preferably able to be equipped for milling work on ground surfaces by connecting its machine frame to an interchangeable milling unit known per se and is able to be equipped for surface-texturing ground work on ground surfaces by connecting its machine frame to an interchangeable unit. The interchangeable unit for surface-texturing ground work may be designed as described above or may be the above-described interchangeable unit. However, it may also structurally deviate from the above-described interchangeable unit.

To ensure the tooling capacity, the road construction machine may comprise an interchangeable milling unit and a further interchangeable unit for surface-texturing earth work, of which only one may be connected to the machine frame at a time.

With regard to possible refinements of the machine frame, the traveling gear, motor and connecting counterpart configurations, what was said above also applies to the present road construction machine.

The present invention is explained in greater detail below with reference to the attached drawings. The figures show:

DETAILED DESCRIPTION

Figure 1:
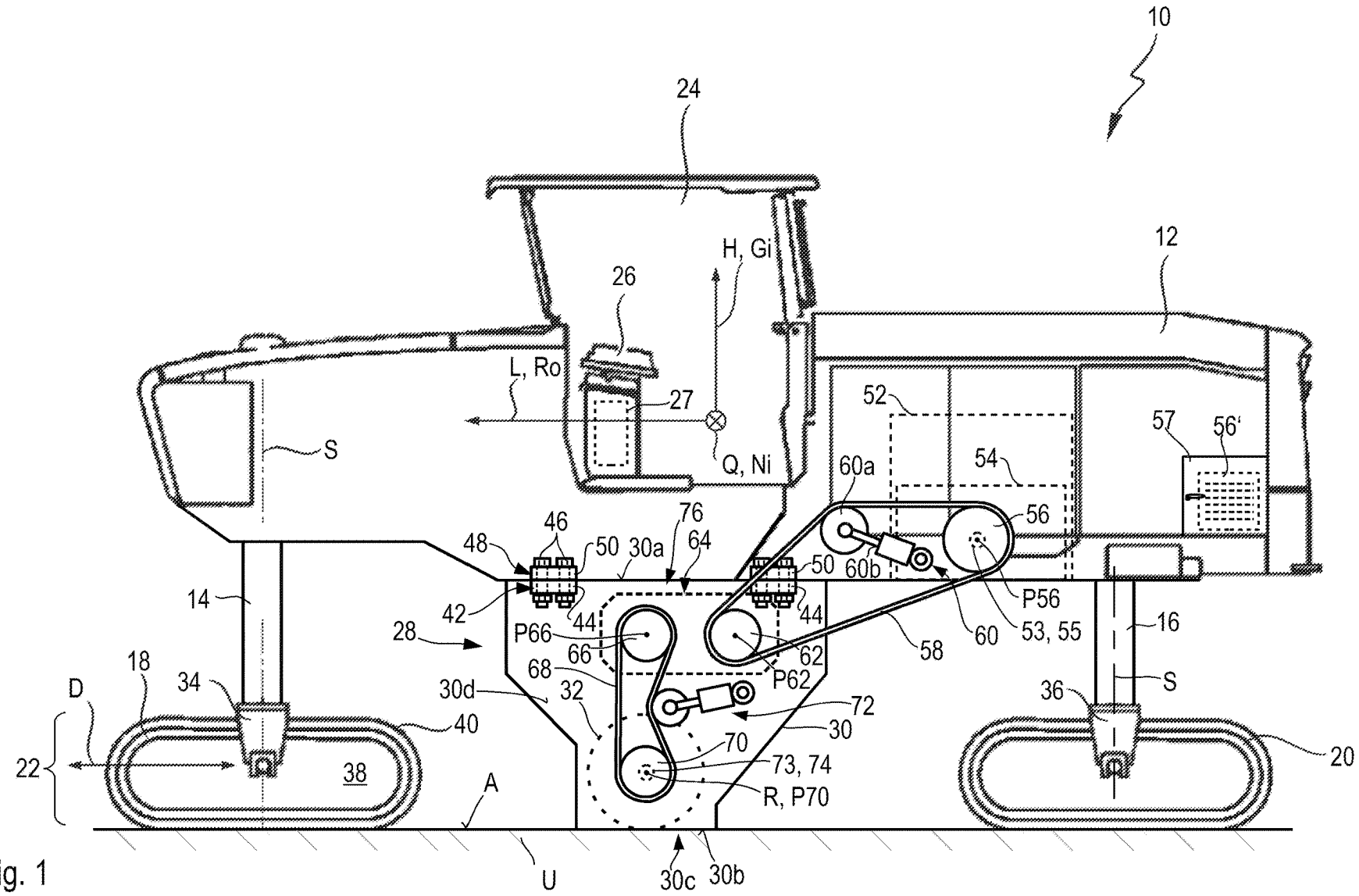
FIG. 1 a rough schematic lateral view in the transverse direction of the machine frame of a road construction machine of the present invention in the exemplary form of a large milling machine, the machine frame of the road construction machine being connected to an interchangeable unit of the present invention.

The viewer of FIG. 1 is looking onto the only schematically drawn road construction machine or simply "machine" 10 in the direction of the transverse machine frame direction Q which is orthogonal to the drawing plane of FIG. 1. The longitudinal machine frame direction is labeled L and extends parallel to the drawing plane of FIG. 1. The vertical machine direction H runs likewise parallel to the drawing plane of FIG. 1 and orthogonal to the longitudinal machine direction L and the transverse machine direction Q. The arrowhead of longitudinal machine frame direction L in FIG. 1 points in the forward direction. Vertical machine frame direction H is parallel to the extension direction of lifting columns 14 and 16. Vertical machine direction H extends parallel to the yaw axis $G_i$ of machine 10, longitudinal machine direction L extends parallel to the roll axis $R_o$, and transverse machine direction Q extends parallel to pitch axis $N_i$.

Road construction machine 10 may comprise an operator's platform 24, from which a machine operator is able to control machine 10 via a control panel 26. Control panel 26 may accommodate a controller 27 of road construction machine 10, which is operated from control panel 26 and which through control interventions of an operator and/or on the basis of preprogrammed control program sequences controls the switching operations and work operations on road construction machine 10 mentioned in the present application. For this purpose, controller 27 comprises at least one integrated circuit and a data memory connected to the latter in data-transmitting fashion.

Below machine frame 12, an interchangeable unit 12 is indicated merely by dashed lines and only in FIG. 1, in this case by way of example as device 28 for texturing ground surfaces using groove cutting drum 32 accommodated in a housing 30 of interchangeable unit 28, which extends along the transverse machine frame direction Q and is rotatable about a working axis R extending in the transverse machine frame direction Q in order thereby to be able to cut grooves into ground material starting from the contact surface A of the ground U to a cutting depth determined by the relative vertical position of machine frame 12. Such grooving-texturing surface work may be used to reduce the generation of rolling noises on the contact surface A and/or to ensure a defined drainage of precipitation and/or to increase the quantity of precipitation removable per unit of time. The groove cutting drum 32 may include a plurality of circular diamond-impregnated saw blades and is sometimes referred to as a grinder or a grinding head.

The vertical adjustability of machine frame 12 by way of lifting columns 14 and 16 therefore also serves to set the cutting depth, or generally working depth, of machine 10 when working the ground. Earth working machine 10 depicted by way of example is a large road milling machine, for which the placement of interchangeable unit 28 between the front and rear drive units 18 and 20 in longitudinal machine frame direction L is typical. Large road milling machines of this kind, or indeed ground-removing machines in general, usually comprise a transport belt in order to transport removed ground material away from machine 10. In the interest of better clarity, a transport belt that is also present in principle in the case of machine 10 is not depicted in FIG. 1. Furthermore, due to the small quantity of removed ground material in comparison with milling work, no transport belt is required for the present surface-texturing ground work, for which the road construction machine 10 depicted in FIG. 1 is currently equipped. The removed material is bound by water and is suctioned off from housing 30, which is advantageously under negative pressure.

It is not apparent from the lateral view of FIG. 1 that machine 10 comprises, in both its front end region and its rear end region, two respective lifting columns 14 and 16 each having a drive unit 18, 20 connected to it. Lifting columns 14 are coupled to drive unit 18 by a coupling structure 34 in a manner known per se. Rear lifting columns 16 are connected to their respective drive unit 20 via a coupling structure 36 constructed identically to coupling structure 34. Drive units 18 and 20 are of substantially identical construction and constitute traveling gear 22 of the machine.

In the example depicted, drive unit 18, having a possible travel direction indicated by double arrow D, comprises a radially inner accommodation structure 38 on which a circulating drive track 40 is arranged. In a departure from the depicted crawler track units 18 and 20, drive units 18 and/or 20 may also be designed as wheel drive units.

Each of lifting columns 14 and 16, and along with these drive units 18 and 20, is respectively rotatable about a steering axis S by way of a steering apparatus (not further depicted).

Interchangeable unit 28 is exchangeable for an interchangeable milling unit. For most of the time of its removal operation, road construction machine 10 carries an interchangeable milling unit comprising a milling drum. The interchangeable unit 28 depicted in rough schematic fashion in FIG. 1, for grooving surface work by way of example, makes it possible to expand the spectrum of work that road construction machine 10 is able to perform. By installing the interchangeable unit 28 including the grooving-cutting drum 32 supported therein, the large road milling machine 10, which hitherto merely performed milling work, becomes also surface-texturing road construction machine 10.

On its side facing machine frame 12, housing 30 has a connecting section 30*a*, by which interchangeable unit 28 is connected to machine frame 12. As connecting configurations 42, connecting section 30*a* has mounting links 44 having through-holes 47 (see FIG. 3), which in the depicted example are penetrated by threaded bolts 46. Threaded bolts 46 also penetrate connecting counterpart configurations 48 of machine frame 12, which likewise have through-holes. Like connecting configurations 42, connecting counterpart configurations 48 are also developed as mounting links 50 for better access for workers who insert and tighten threaded bolts 46. The number of mounting links 44 and 50 as well as threaded bolts 46 may and normally will deviate from the number depicted in FIG. 1.

In its lower end region opposite from connecting section 30 along yaw axis $G_i$, housing 30 or interchangeable unit 28 has a working section 30*b* having a working opening 30*c*, through which grooving-cutting drum 32 protrudes in order to make material-removing contact with ground U.

Supported on machine frame 12, an internal combustion engine 52 having a crankshaft 53 extending along pitch axis $N_i$ as a motor output shaft is indicated by dashed lines on road construction machine 10, crankshaft 53 being coupled on the output side to a preferably switchable pump transfer gear 54, which is likewise indicated only in rough schematic fashion by dashed lines. A gear output shaft 55 of pump transfer gear 54, which is coaxial with respect to the axis of rotation of crankshaft 53, supports an output belt pulley 56, which rotates about an output belt pulley axis P56 that is parallel to pitch axis $N_i$. The pump transfer gear 54 may also be referred to as a pump gear drive 54.

Using the drive force of motor 52 transmitted to it by pump transfer gear 54, output belt pulley 56 drives a revolving drive belt 58, which is able to be tensioned by variable tensional force via a drive belt tensioner 60. For this purpose, drive belt tensioner 60 has a tensioning roller 60*a* abutting against the inner circumference of drive belt 58, which is displaceable via a piston-cylinder assemblage 60*b* as actuator against the inner circumference of drive belt 58 and away from the latter. Changing the tension of drive belt 58 makes it possible to change the force transmittable from output belt pulley 56 to drive belt 58 and thereby change the torque maximally transmittable by drive belt 58.

For retooling road construction machine 10 in a precisely targeted manner, road construction machine 10 may carry along a further output belt pulley 56' in a storage space 57, which is exchangeable for the output belt pulley 56 active in FIG. 1, if required. The further output belt pulley 56' has a different diameter than output belt pulley 56.

Drive belt 58 transmits torque onto a drive belt pulley 62 situated on interchangeable unit 28, which rotates about a drive belt pulley axis P62 extending parallel to pitch axis $N_i$. Drive belt pulley 62 is connected to a gear wheel transmission stage 64 (not shown in detail in FIG. 1), which transmits torque from drive belt pulley 62 to an intermediate belt pulley 66. Each belt pulley 62 and 66 is coupled respectively to one gear wheel of gear wheel transmission stage 64 comprising an even number of pairwise mutually meshing gear wheels so that the direction of rotation is reversed in the transmission of torque from drive belt pulley 62 to intermediate belt pulley 66. Intermediate belt pulley 66 therefore rotates in the opposite direction as drive belt pulley 62. Intermediate belt pulley 66 rotates about an intermediate belt pulley axis P66 that is parallel to pitch axis $N_i$ and thus also to working axis R.

Intermediate belt pulley 66 drives a working belt 68, which runs at a distance from intermediate belt pulley 66 about a working belt pulley 70. Working belt 68 is tensionable by a working belt tensioner 72 in the same manner as drive belt 58 is tensionable by drive belt tensioner 60. Working belt tensioner 72 is structurally designed like drive belt tensioner 60.

Working belt pulley 70 rotates about a working belt pulley axis P70 that is coaxial to working axis R. In the depicted example, working belt pulley 70 is rigidly connected to grooving-cutting drum 32 via a working shaft assemblage 74 formed by a single working shaft 73 and transmits the torque received from intermediate belt pulley 66 directly and immediately in the same direction to grooving-cutting drum 32. Working shaft 73 and therewith working shaft assemblage 74 penetrate lateral wall 30*d* of housing 30. The shaft connections of intermediate belt pulley 66 and of drive belt pulley 62 with their respective gear wheels of gear wheel transmission stage 64 also penetrate lateral wall 30*d* of housing 30.

Gear wheel transmission stage 64, intermediate belt pulley 66, working belt pulley 70, and working belt 68 form a transmission gear 76, which transmits torque from drive belt pulley 62 to grooving-cutting drum 32 while reversing the direction of rotation. Drive belt pulley 62 and grooving-cutting drum 32 therefore rotate in opposite directions.

Figure 2:
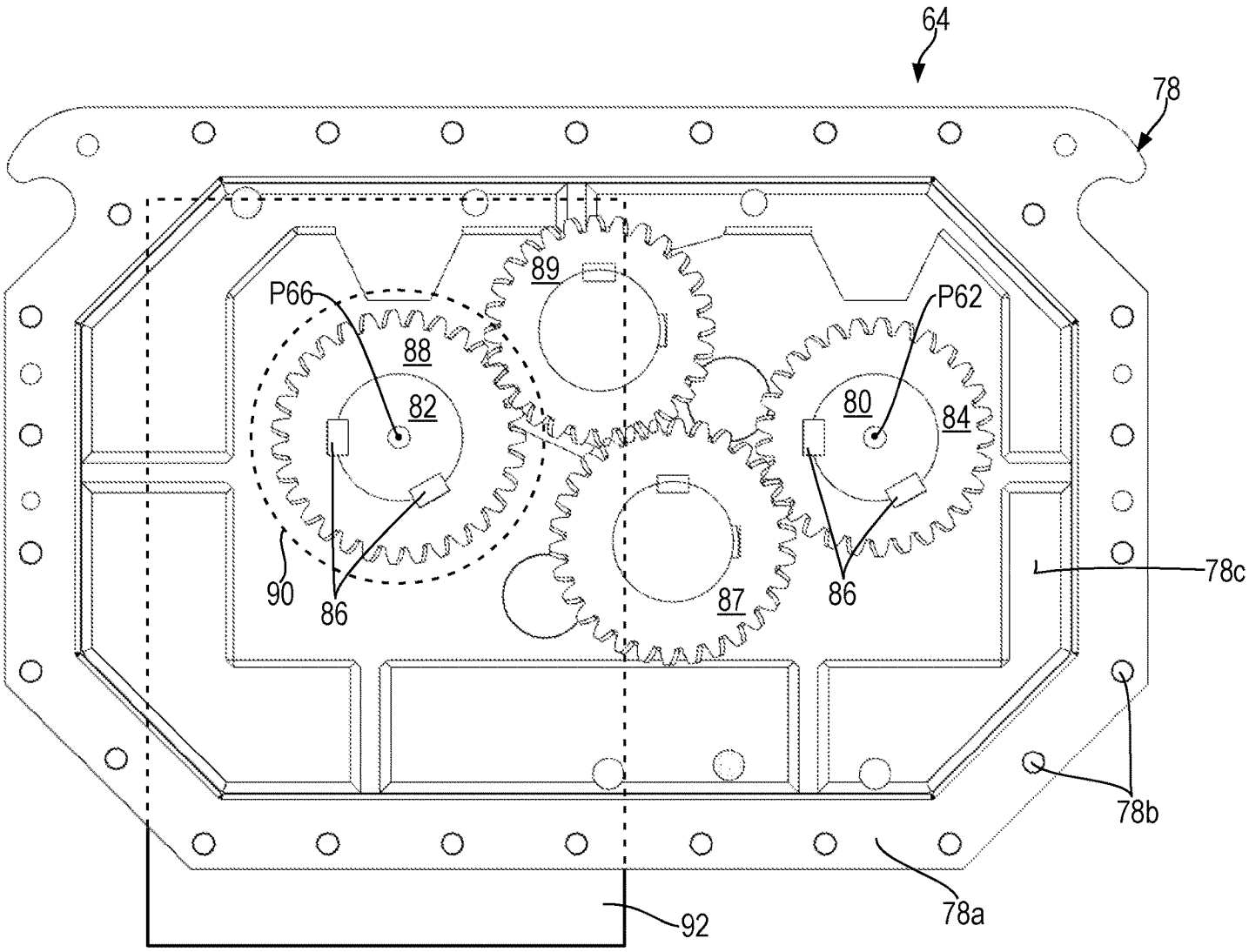
FIG. 2 a rough schematic top view onto a gear wheel transmission stage on the interchangeable unit of the road construction machine from FIG. 1.

FIG. 2 shows gear wheel transmission stage 64, a front wall of transmission housing 78, which faces lateral wall 30*d* of housing 30 and lies directly across from it in the installed state, having been omitted in order to show the gear wheels of gear wheel transmission stage 64 in more detail.

Transmission housing 78 comprises a circumferential mounting flange 78*a* having a plurality of mounting bores 78*b*, which are penetrated by screws (not shown) in order to fasten the transmission housing 78, which completely encloses gear wheel transmission stage 64, to the inner side of lateral housing wall 30*d* that is facing away from the viewer of FIG. 1. The back wall 78*c* shown in FIG. 2 is ribbed in a manner known per se to increase its stiffness.

Belt pulley axes P62 and P66 run orthogonally with respect to the drawing plane of FIG. 2. Belt pulley shafts rotating about the respective belt pulley axes may be seen in the FIG., namely, drive belt pulley shaft 80 connected in a rotationally fixed manner to drive belt pulley 62 and intermediate belt pulley shaft 82 connected in a rotationally fixed manner to intermediate belt pulley 66.

Drive belt pulley shaft 80 penetrates a drive gear wheel 84 and is coupled with positive fit to drive gear wheel 84 via two springs 86 for joint rotation. In the same manner, intermediate belt pulley shaft 82 is connected in a rotationally fixed manner to the intermediate gear wheel 88 that it penetrates.

Drive gear wheel 84 meshes with a first mediator gear wheel 87, which in turn meshes with a second mediator gear wheel 89, which in turn meshes with intermediate gear wheel 88. Gear wheels 84, 87, 89, and 88 form a gear wheel train for transmitting torque between drive belt pulley 62 and intermediate belt pulley 66. If drive gear wheel 84 and intermediate gear wheel 88 are sufficiently large, they may also mesh directly with one another, in which case given the center distance between the belt pulley axes P62 and P66 depicted in FIG. 2 the volume enclosed by transmission housing 78 would have to be greater.

The entire gear wheel transmission stage 64 has a speed transmission ratio of between 0.9 and 1.3. Each individual meshing gear wheel pairing of gear wheel transmission stage 64 likewise has a speed transmission ratio of between 0.9 and 1.3. The concrete embodiment of the speed transmission ratio also depends on the selection of the diameters of the belt pulleys 56, 62, 66, and 70 involved in the torque transmission since the diameter ratios of belt pulleys that are coupled by a common belt also establish a transmission ratio.

As is indicated in FIG. 2 by dashed lines, intermediate belt pulley shaft 88 exits transmission housing 78 through back wall 78*c* and is there connected, concealed for the viewer of FIG. 2 by transmission housing 78, to a first clutch component of a switchable start-up clutch 90. A second clutch component, which selectively may be brought into a torque-transmitting connection with the first clutch component or may be separated from the latter by switching the start-up clutch 90, is connected to a start-up motor 92. Start-up motor 92 may be an electric motor or a hydraulic motor. It is preferably supplied with energy by a machine frame-side source of energy. This energy supply connection is established when interchangeable unit 28 is connected to machine frame 12 and is disconnected again when interchangeable unit 28 is released from machine frame 12.

Start-up motor 92 is able to accelerate grooving-cutting drum 32, which is coupled to intermediate belt pulley shaft 82 and to intermediate belt pulley 66 supported by it, from standstill or from a low starting speed to a first limit speed, from which point onward motor 52 of road construction machine 10 takes over the further acceleration up to the predetermined removal speed. When transferring the drive function from start-up motor 92 to main motor 52, drive belt tensioner 60 together with drive belt 58 may be used as a slip clutch by displacement and consequently by changing the tension of drive belt 58.

Likewise, when braking grooving-cutting drum 32, start-up motor 92 may be used as a resistance to rotation, for example in that grooving-cutting drum 32 drives start-up motor 92 in generator operation or drives it as a hydraulic pump in the case in which start-up motor 92 is a hydraulic motor.

Figure 3:
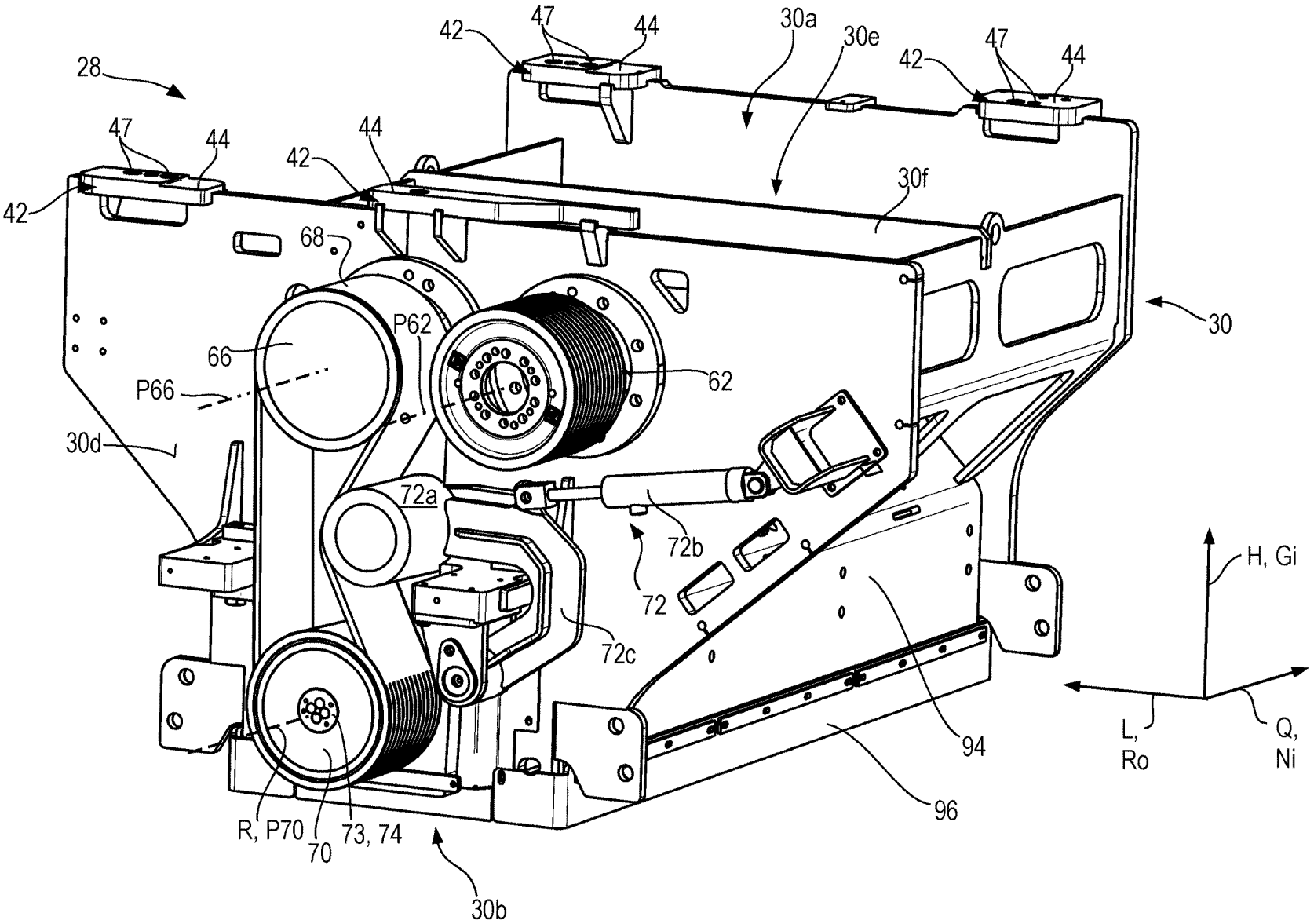
FIG. 3 a rough schematic perspective view of the interchangeable unit of the road construction machine from FIG. 1 shown in isolation.

FIG. 3 shows a perspective view of interchangeable unit 28. The figure shows a drum basin 94 surrounding the grooving-cutting drum 32 at a small radial distance, which is formed in the lower region of housing 30 and which comprises working opening 30*c*. An end strip 96 comprising an elastic lip toward ground surface A terminates working opening 30*c* as tightly as possible with ground surface A so that a dirt load produced by the grooving-cutting drum during ground work is as low as possible in the outer surroundings of interchangeable unit 28.

A region 30*e* of housing 30 situated above drum basin 94 and extending up to connecting section 30*a* is protected by drum basin 94 against the dirt produced and stirred up by grooving-cutting drum 32 and is therefore able to act as a cavity for accommodating for example gear wheel transmission stage 64, switchable start-up clutch 90 and start-up motor 92. A longitudinal wall 30*f* in region 30*e*, which is orthogonal with respect to working axis R, may be used for mounting start-up motor 92, for example. The front wall of transmission housing 78 may therefore be formed by lateral wall 30*d* of housing 30.

Working belt tensioner 72 comprises a tensioning roller 72*a* and a piston-cylinder assemblage 72*b* as actuator for displacing tensioning roller 72*a*, tensioning roller 72*a* and piston-cylinder assemblage 72*b* being coupled by a lever mechanism 72*c*.

The invention claimed is:

1. An interchangeable unit for removing material from a ground surface, the interchangeable unit being configured for operational physical and functional coupling to a machine frame of a road construction machine, the interchangeable unit comprising:

a housing including:

a connecting section configured to physically couple the interchangeable unit to the road construction machine, the connecting section including a plurality of connecting configurations configured to mount the interchangeable unit to the machine frame of the road construction machine; and a working section including a working opening, the working section located remotely from the connecting section;

a removal tool, mounted to the housing and rotatable about a working axis such that a circumferential section of the removal tool protrudes from the working opening;

a drive belt pulley rotatably mounted on the housing and configured to be coupled to a drive belt for functionally coupling the interchangeable unit to the road construction machine, the drive belt pulley including an axis of rotation spaced from the working axis of the removal tool;

a transmission gear unit configured to transmit torque and rotary motion from the drive belt pulley to the removal tool;

a start-up motor; and a start-up clutch configured to connect the start-up motor and the removal tool in a torque-transmitting fashion such that the start-up motor is disengageable from the removal tool.

2. The interchangeable unit of claim 1, wherein:

the transmission gear unit includes an intermediate belt pulley; and the start-up clutch is configured to connect the start-up motor to one of the drive belt pulley or the intermediate belt pulley.

3. The interchangeable unit of claim 1, further comprising:

a controller configured to switch the start-up clutch into a, or hold the start-up clutch in a, torque-transmitting connection state if the removal tool rotates at a speed that is lower than or equal to a first limit speed, the first limit speed being lower than a removal speed of the removal tool during normal removal operation of the removal tool.

4. The interchangeable unit of claim 3, wherein:

the controller is further configured to switch a drive belt tensioner into an, or hold the drive belt tensioner in an, operating state such that a belt tension of the drive belt is at an idling tension when the removal tool rotates at a speed lower than a second limit speed, the idling tension being lower than an operating tension of the drive belt during normal removal operation of the removal tool, and the second limit speed being lower than or equal to the first limit speed.

5. The interchangeable unit of claim 4, wherein:

the controller is further configured to change the belt tension of the drive belt such that the belt tension of the belt drive is between the idling tension and the operating tension, the change in the tension of the drive belt corresponding to the change of the speed of the removal tool between the second limit speed and the removal speed.

6. The interchangeable unit of claim 1 in combination with the road construction machine, wherein:

the road construction machine includes:

the machine frame;

a traveling gear including at least three drive units configured to rollably stand on the ground surface;

a motor including an output shaft configured to provide torque;

an output belt pulley drivable by the motor;

a plurality of counterpart configurations engaged with the plurality of connecting configurations for mounting the interchangeable unit to the machine frame of the road construction machine; and the drive belt connecting the output belt pulley to the drive belt pulley in torque-transmitting fashion.

7. The interchangeable unit in combination with the road construction machine as recited in claim 6 further comprising:

a controller configured to:

switch the start-up clutch into a, or hold the start-up clutch in a, torque-transmitting connection state if the removal tool rotates at a speed that is lower than or equal to a first limit speed, the first limit speed being lower than a removal speed of the removal tool during normal removal operation of the removal tool;

switch a drive belt tensioner into an, or hold the drive belt tensioner in an, operating state such that a belt tension of the drive belt is at an idling tension when the removal tool rotates at a speed lower than a second limit speed, the idling tension being lower than an operating tension of the drive belt during normal removal operation of the removal tool, and the second limit speed being lower than or equal to the first limit speed; and change the belt tension of the drive belt such that the belt tension of the belt drive is between the idling tension and the operating tension, the change in the tension of the drive belt corresponding to the change of the speed of the removal tool between the second limit speed and the removal speed.

8. The interchangeable unit of claim 1, wherein:

the start-up motor and the start-up clutch are located within the housing of the interchangeable unit.

9. The interchangeable unit of claim 1, wherein:

the start-up motor is an electric motor.

10. The interchangeable unit of claim 1, wherein:

the start-up motor is a hydraulic motor.

11. A method of starting up a removal tool of an interchangeable unit of a road construction machine:

wherein the interchangeable unit includes:

a housing;

a removal tool mounted on the housing;

a drive belt pulley rotatably mounted on the housing;

a transmission gear unit configured to transmit torque and rotary motion from the drive belt pulley to the removal tool;

a start-up motor; and a start-up clutch configured to connect the start-up motor and the removal tool in a torque-transmitting fashion such that the start-up motor is disengageable from the removal tool;

wherein the road construction machine includes:

a machine frame, the housing being mounted to the machine frame;

at least three drive units configured to rollably stand on a ground surface;

a motor;

an output belt pulley drivable by the motor; and a drive belt connecting the output belt pulley to the drive belt pulley;

the method comprising:

switching the start-up clutch into a, or holding the start-up clutch in a, torque-transmitting connection state if the removal tool rotates at a speed that is lower than or equal to a first limit speed, the first limit speed being lower than a removal speed of the removal tool during normal removal operation of the removal tool.

12. The method of claim 11, further comprising:

switching a drive belt tensioner into an, or holding the drive belt tensioner in an, operating state such that a belt tension of the drive belt is at an idling tension when the removal tool rotates at a speed lower than a second limit speed, the idling tension being lower than an operating tension of the drive belt during normal removal operation of the removal tool, and the second limit speed being lower than or equal to the first limit speed.

13. The method of claim 12, further comprising:

changing the belt tension of the drive belt such that the belt tension of the belt drive is between the idling tension and the operating tension, the change in the tension of the drive belt corresponding to the change of the speed of the removal tool between the second limit speed and the removal speed.

* * * * *